United States Patent [19]

Lee

[11] Patent Number: 4,502,622

[45] Date of Patent: Mar. 5, 1985

[54] LEVER MEANS IN A TAG ATTACHING APPARATUS

[76] Inventor: Duck H. Lee, Minyong Apartment, Block "Q", Room No. 606, 301-112, Ichon-dong, Yongsan-Ku, Seoul, Rep. of Korea

[21] Appl. No.: 447,633

[22] Filed: Dec. 7, 1982

[51] Int. Cl.[3] ..... B25C 1/00

[52] U.S. Cl. ..... 227/67; 74/524

[58] Field of Search ..... 74/524, 519; 227/67, 227/129, 132, 133, DIG. 1

[56] References Cited

U.S. PATENT DOCUMENTS 3,650,452 3/1972 Finke ..... 227/67

3,652,004 3/1972 Lozio ..... 227/67

3,924,788 12/1975 Furutu ..... 227/67

*Primary Examiner*—James A. Leppink

*Assistant Examiner*—Frank H. McKenzie, Jr.

*Attorney, Agent, or Firm*—Oblon, Fisher, Spivak, McClelland & Maier

[57] ABSTRACT

An improved lever means in a tag attaching apparatus obtained by adding tension to the handle of the tag attaching apparatus. An assistant lever containing three slots is located in the space between the shooting lever and the action lever, pushing the fastener onto the needle groove to attach the tags to the objects. The bottom slot of the assistant lever is connected to the hinge point of the action portion, and the hinge point of the assistant lever is connected to the shooting lever.

1 Claim, 3 Drawing Figures

LEVER MEANS IN A TAG ATTACHING APPARATUS

DETAILED EXPLANATION OF INVENTION

Figure 1:
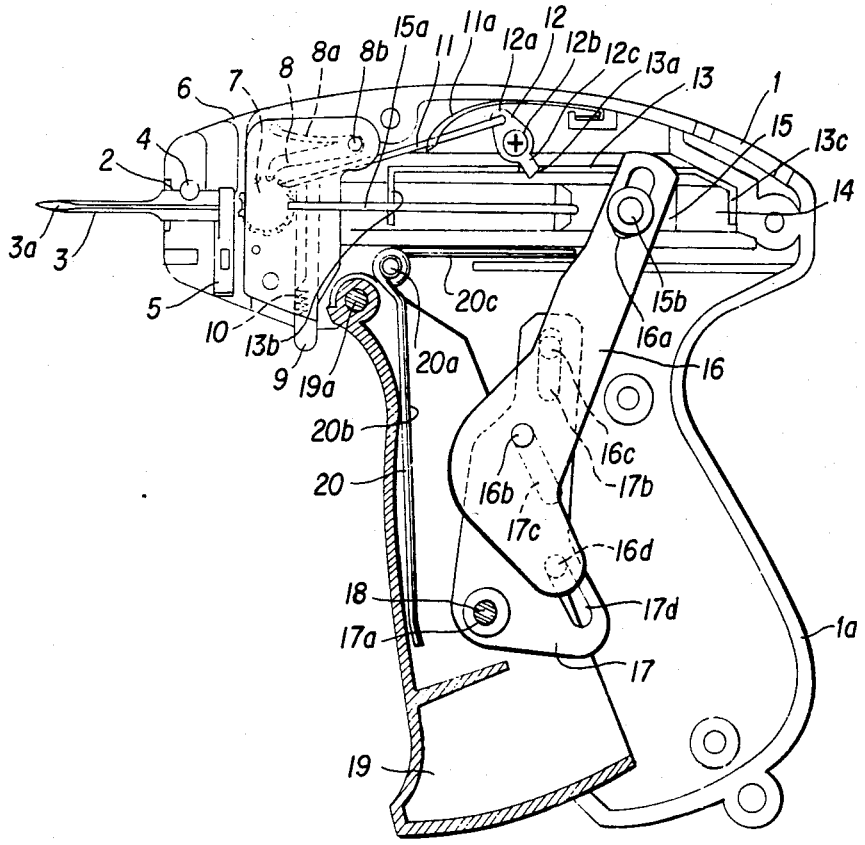
FIG. 1 is the side elevational view, removed one side from the tag attaching apparatus of the present invention to show clearly the construction.
Figure 2:
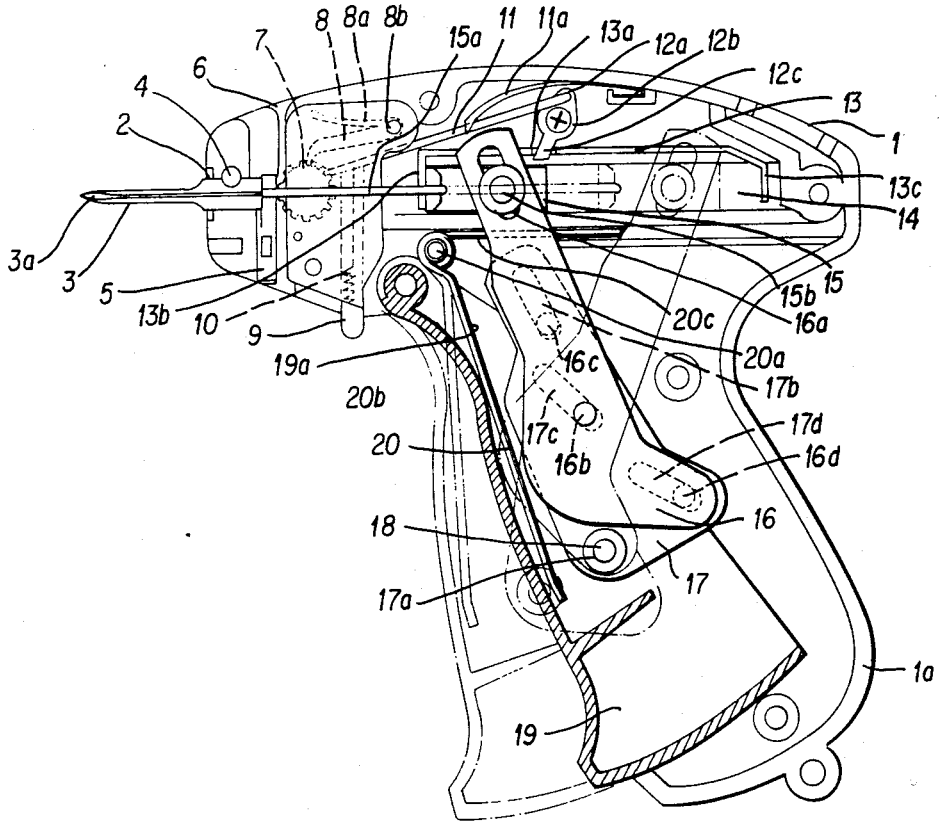
FIG. 2 is an embodiment illustrating in detail how the present invention is operated.
Figure 3:
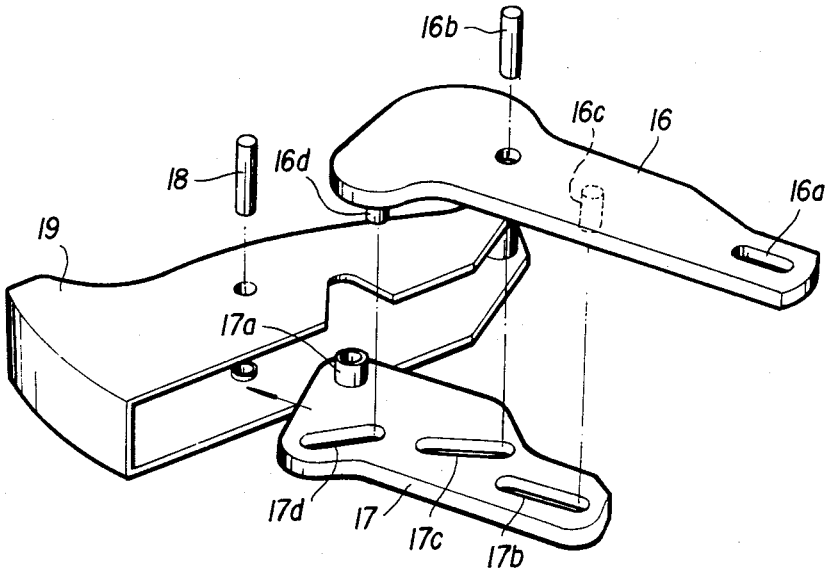
FIG. 3 is the perspective view disjointed the lever means, which consists of the action portion, the assistant lever and the drawing lever, characterized by the present invention.

This invention relates to an improvement and reform relating to the lever means in a tag attaching apparatus. According to the present invention, by adding a short scope of the tension to the handle of the tag attaching apparatus, it is possible to attach smoothly and easily the tags to the objects.

According to the present invention, the assistant lever containing three slots is located on the space between the shooting lever and the action lever pushing the fastener onto the needle groove to attach the tags to the objects. The bottom slot of the assistant lever is connected to the hinge point of the action portion and the hinge point of the assistant lever is connected to the shooting lever. Since the central force acting point of the action portion is placed on the upper slot, when the drawing lever is drawn inwardly in a short distance, by the force of the shooting lever, the assistant lever moves downwardly and then induces a strong force and draws the action portion and therefore the slider connected to the action portion can act in a sufficient distance and the pushing pole pushes the fastener to the needle groove so that the tags can be attached to the objects.

Further, the purpose of the present invention is to improve the defects in the prior tag attaching apparatus. According to the present invention, by adding a small force to the tag attaching apparatus, it is possible to remove the tireness of the human hands using the tag attaching apparatus so that the laborers in the factory can work more effectively and for a long time to attach the tags to the objects.

According to the common prior arts, it is notable that the tags attaching apparatus contains the fastener supplying gear, the pushing pole which pushes the fastener on the needle groove to attach the tags to the objects, the slider to administrate the pushing pole, the action portion operating the slider, the lever operating the action portion, etc. Although we can find another prior arts containing a difference in the construction, it is common that the shooting lever is connected to the action portion so that, when the shooting lever is drawn inwardly, the action portion moves and induces the movement of the slider and, then, by the movement of the slider, the pushing pole pushes the fastener and the tag is attached to the objects.

However, according to the prior arts, in order to move the slider to a distance to push the fastener to attach the tag to the objects, it is required that the connection between the slider and the action portion must produce a large moving angle and, in order to obtain the said angle, the shooting lever must be drown until a distance to produce sufficiently such a moving angle. The action to draw the shooting lever to a large moving angle is to demand a large force from the user so that the user cannot maintain continuously and several times the action to attach the tags to the articles. Since the textile goods manufacturing factories used commonly to attach several tags as well as labels on the clothes manufactured, if the operation of the tag attaching apparatus may require a large force from the user, the activity and efficiency are reduced and, since the works are operated by the women labors having the weaken hands, there is a need to improve and reform the tag attaching apparatus to a new one which is operated easily and effectively by everybody.

The invention of the present application is illustrated in detail, in accordance with the accompanying drawings, as follows:

The tag attaching apparatus (1) contains the trigger (1*a*) like a pistol. The body of the tag attaching apparatus (1) has the needle charging hole (2) and the needle (3) having the concave home (3*a*) is inserted into the needle charging hole (2) and is fixed by the fixing screw (4). On the below of the fastener inlet (6) located vertically on the one side of the body of the tag attaching apparatus (1), there is the fastener cutting blade (5) and, on the middle area of the fastener inlet (6), there is the fastener supplying gear (7). The "λ"-shaped stopper (8) containing the spring (8) is installed to be hinged at the point (8*b*) and the bottom end of the stopper (8) is bitten by the teeth of the gear (7). The body of the tag attaching apparatus (1) has the small lever (12) supported by the hinge point (12*b*) located on the upper part of the central area of the said body and the portion (12*a*) of the lever (12) is connected to the upper art of the driving pole (11) and the bottom part of the driving pole (11) is touched with the gear (7). The upper part of the driving pole (11) is linked to the plate spring (11*a*) and the bottom part (12*c*) of the lver (12) is inserted into the hole (13*a*) placed on the central part of the moving member (13) in the "⌐¬"-shaped so that, by the movement of the moving member (13), the lever (12) can move to the right and left direction. On the upper part of the body of the tag attaching apparatus (1), there is the guide home (14) digged laterally and the slider is connected to which. On the one side of the slider (15), there is the pushing pole (15*a*) pushing the fastener by the needle and the pushing pole (15*a*) is located in a position corresponding to the concave groove (3*a*) of the needle (3). During the going and returning movement of the pushing pole (15*a*) at the concave groove (3*a*) of the needle (3), the pushing pole (15*a*) pushes the tag attaching fastener so that the tag can be attached to the objects.

The support point (15*b*) equipped on the another side of the slider (15) is connected to the slot (16*a*) of the action portion (16). In the embodiment that the action portion (16) is located on the central part of the body (1) by the support point (16*b*), the slot (17*b*) located on the central area of the assistant lever (17) containing thee slots (17*b*, 17*c* and 17*d*) is connected to the support point (16*c*) of the action portion (16) and the upper slot (17*b*) of the assistant lever (17) is connected to the central support point (16*c*) of the action point (16). The slot (17*d*) located on the below area of the assistant lever (17) is connected to the support point (16*d*) located on the below area of the action portion (16) and the slot (17*a*) located on the assistant lever (17) is connected to the central area of the drawing lever (19) by the support point (18). On the upper part of the support point (19*a*) of the drawing lever (19), the "⌐¬"-shaped spring (10) is installed through the support point (20*a*). The upper end (20*c*) of the spring (20) is connected to the upper part of the body and the bottom end (20*b*) of the spring (20) is connected to the drawing lever (19) so that the drawing lever (19) can be always opened.

The number 9 in the drawing is the pushing member pressing upwardly the driving pole (11) to separate from the gear (6) and the number 10 is the small spring inducing the pushing member to return.

The action and effect of the present invention is explained in detail, as follows:

Through the fastener inlet (6), a series of the fasteners is charged in a line. After the tag and the object are pierced by the needle (3), the drawing lever (19) is drawn. When the lever (19) is drawn, the spring (20) is pressed and, then, the lever (19) moves at the point of the supporting axis (19*a*) and therefore the assistant lever (17) moves at the point of the supporting axis (16*c*) to induce a shake of the support point (18) and, then, the assistant lever (17) shakes upwardly by the shake of the drawing lever (19). Because the slot (17*b*) located on the middle area of the assistant lver (17) is pushed upwardly, each of the slots (17*c*) and (17*d*) moves upwardly. Because the assistant lever (17) acts at the support point (16*c*) the shake by moving upwardly, the upper part of the assistant lever (17) produces a great shaking angle and draws with a great shaking angle the upper support point (16*c*) of the action portion (16) connected to the upper slot (17*b*). Since the slider (15) connected to the slot (16*a*) located on the upper area of the action portion (16) can obtain a sufficient distance to cause the shake at the guide home (14), the pushing pole (15*a*) equipped to the slider (15) can push one of the fasteners into the concave groove (3*a*) of the needle (3) so that the tag can be attached to the object.

As explained above, according to the present invention, when the drawing lever is drawn, the action portion acts to produce a great shaking angle and also induces the slider to charge one of the fasteners into the concave groove of the needle.

According to the present invention, in order to remove the defects in the prior arts that the drawing lever must be drawn with a large force to induce the slider to charge one of the fasteners into the concave groove of the needle, the tag attaching apparatus of the present invention contains characteristically the assistant lever containing three slots, instead of the construction that the drawing lever is directly connected to the action portion as shown in the prior arts. Between the drawing lever and the action portion, there is further the assistant lever containing three slots. The bottom part of the assistant lever is connected to the drawing lever and the long slot of the assistant lever is connected to the supporting axis of the action portion so that, when the drawing lever is drawn, the supporting point of the assistant lever may move and produce a large shaking angle at the upper part of the assistant lever. Even if the drawing lever is drawn in a short shaking angle, it is possible to move the slider in a sufficient distance and to induce the needle to push the fastener and therefore the tags can be attached easily to the objects. When we compare the present invention with the prior arts, since the tag attaching apparatus of the present application can attach the tags to the objects by drawing the drawing lever in a short distance so that the tireness of the hands can be reduced, the woman labors can also use easily the tags attaching apparatus of the present invention and use this tag attaching apparatus efficiently for a long time.

What is claimed is:

1. A tag attaching apparatus comprising:

(a) a body having a lower part for manipulation by the user and an upper part which contains the tag attaching components of the apparatus;

(b) a guide home formed in the upper part of said body;

(c) a slider disposed in said guide home;

(d) a pushing pole operatively connected to said slider;

(e) a needle slidably disposed in the upper part of said body adjacent said pushing pole;

(f) manually actuable drive means disposed in the lower part of said body and operatively connected to said slider, said drive means being pivotably mounted on a pivot which goes through the middle of said drive means and which is mounted in the lower part of said body;

(g) a drawing lever pivotably mounted on the upper part of said body; and (h) an assistant lever pivotably mounted on said drawing lever about a hinge, said assistant lever containing a central slot operatively connected to said drive means, an upper slot operatively connected to said drive means, and a lower slot operatively connected to said drive means, whereby, when said drawing lever is drawn, said hinge on said assistant lever moves.

* * * * *